US007572137B2

(12) United States Patent
Fekonja

(10) Patent No.: US 7,572,137 B2
(45) Date of Patent: Aug. 11, 2009

(54) ELECTRICAL PLUG-IN CONNECTION SYSTEM

(75) Inventor: Rudolf Fekonja, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 12/236,313

(22) Filed: Sep. 23, 2008

(65) Prior Publication Data

US 2009/0075504 A1 Mar. 19, 2009

Related U.S. Application Data

(63) Continuation of application No. PCT/EP2007/002052, filed on Mar. 9, 2007.

(30) Foreign Application Priority Data

Mar. 24, 2006 (DE) ..... 10 2006 014 086

(51) Int. Cl.
*H01R 4/50* (2006.01)

(52) U.S. Cl. ..... 439/347; 439/259

(58) Field of Classification Search ..... 439/310, 439/259, 265–269, 345, 347
See application file for complete search history.

(56) References Cited

U.S. PATENT DOCUMENTS 5,411,406 A 5/1995 Kondo
6,224,411 B1 5/2001 Maag
6,736,682 B1 5/2004 Groebmair et al.

FOREIGN PATENT DOCUMENTS

DE 195 08 189 A1 9/1996
DE 199 12 426 A1 9/1999
DE 199 48 037 B4 5/2001
EP 0 982 808 A1 3/2000

OTHER PUBLICATIONS

German Search Report dated Feb. 21, 2007 with English translation (Nine (9) pages).

*Primary Examiner*—Khiem Nguyen
(74) *Attorney, Agent, or Firm*—Crowell & Moring LLP

(57) ABSTRACT

An electrical plug-in connection system has a first electrical plug-in connection element and a second electric plug-in connection element complementary thereto. Pertaining first and a second housings having a number of contact elements corresponding to the number of the wires in the one housing and a corresponding number of opposite contact elements in the other housing are provided. An electrical plug-in connection between the contact elements and their respective opposite contact elements can be established and released again respectively by a relative movement of the two housings. A locking connection occurs between the two housings, which can be established and detached again. A two-step operating mechanism is provided, where, during the relative movement of the two housings in a first step, a locking of the two housings takes place essentially without providing contact between the contact elements and their respective opposite contact elements, and where, during the transition into an end position as the second step, the actual providing of contact between the contact elements and their respective opposite contact elements takes place with a position-dependent increase of the contact force.

5 Claims, 2 Drawing Sheets

ELECTRICAL PLUG-IN CONNECTION SYSTEM

CROSS REFERENCE TO RELATED APPLICATIONS

This application is a continuation of PCT International Application No. PCT/EP2007/002052, filed Mar. 9, 2007, which claims priority under 35 U.S.C. § 119 to German Patent Application No. 10 2006 014 086.9, filed Mar. 24, 2006, the entire disclosures of which are herein expressly incorporated by reference.

BACKGROUND AND SUMMARY OF THE INVENTION

The invention relates to an electrical plug-in connection system.

A plug-in connection system is known from German patent document DE 199 48 037 B4. The characteristic feature of this system on the mechanical side is the electric plug-in connection between the contact elements and their respective opposite contact elements, which can be established and detached again by the relative movement of the two housings, as well as the locking connection, which can be established and detached again between the two housings. Electrically, the contacting is to take place essentially by a relative movement after the essentially complete guiding-together of the two housings. This movement may be a swiveling, a rotation, a tilting, or a combination of these movements.

It is an object of the present invention to further develop an electrical plug-in connection element and system such that an easy and cost-effective possibility is created of an operationally reliable electric contacting without carrying out an additional movement between the two housings.

This object is achieved by an electrical plug-in connection system having a first electrical plug-in connection element and a second electrical plug-in connection element complementary thereto, having a pertaining first and a second housing, and having a number of contact elements corresponding to the number of the wires in the one housing and a corresponding number of opposite contact elements in the other housing. An electrical plug-in connection between the contact elements and their respective opposite contact elements, which electrical plug-in connection can be established and released again respectively by a relative movement of the two housings, is provided. A locking connection between the two housings can be established and detached again. A two-step operating mechanism is provided, where, during the relative movement of the two housings in a first step, a locking of the two housings takes place essentially without providing contact between the contact elements and their respective opposite contact elements, and where, during the transition into an end position as the second step, the actual providing of contact between the contact elements and their respective opposite contact elements takes place with a position-dependent increase of the contact force.

The invention advantageously carries out the relative movement of the two housings in a controlled fashion in the form of a two-step locking, and carries out the contacting essentially in the moving range of the two housings between the first and the second locking position. Another advantageous feature of the plug-in system according to the invention consists of the position-dependent increase of the contact force. This applies to the fact that the contact force is lower at the start of the addressed moving range than at the end.

A preferred embodiment of the invention is based on the fact that one of the two housings consists of two partial housings, which can be moved relative to one another. This offers a large constructive range because the two influential functions, specifically the locking and the contacting, can each be carried out by a partial housing, and the respective partial housing can be optimally adapted to this function. In order to ensure that the contacting operation takes place in a reliable fashion, a relative movement of the two partial housings may not be permitted before the transition from the first to the second step. It is only during the relative movement of the two partial housings that the variable contact force between the two pertaining contact elements can be triggered transversely to the movement direction of the two housing parts.

The contact force may be applied discontinuously or essentially continuously. In the latter case, a ramp may be constructed for this purpose in one of the housings by way of which a pressure part can be moved in the other housing. As a result of the interaction of the ramp and the pressure part, a position-dependent increase of the contact force can be caused in a particularly easy manner between the contact elements and their respective opposite contact elements.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1A:
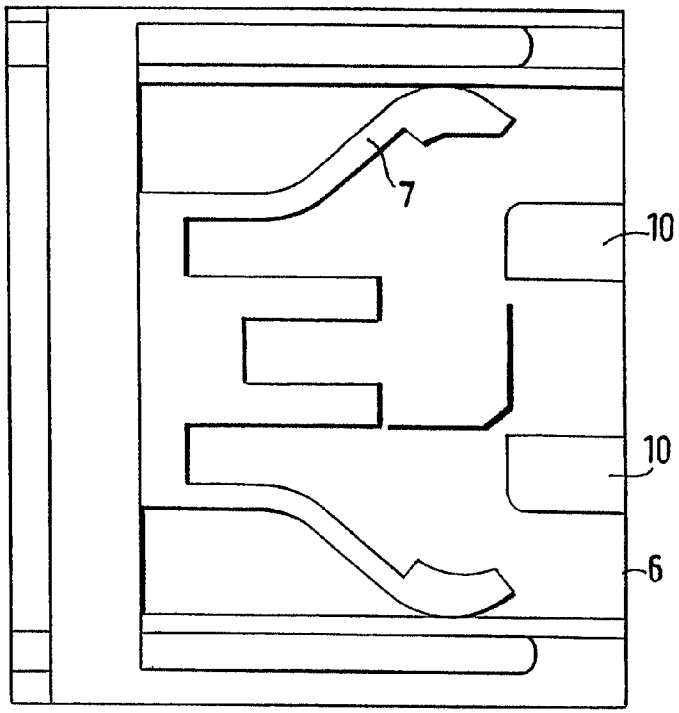
FIGS. 1*a* and 1*b* illustrate a plug-in connection system according to the invention in two characteristic positions.

The plug-in connection system of FIG. 1 includes two electrical contacts, respectively, which are symmetrically arranged about its center line and have two plug-in connection elements 1 and 2 respectively, which are mutually joined. The pertaining contact is illustrated in a simplified fashion. It consists of the two contact parts 3 and 4, which are each assigned to one of the plug-in connection elements 1 and 2. During the joining of the plug-in connection elements 1 and 2, the contact parts 3 and 4 slide onto one another and rest on one another in their operative position. They establish an electrical connection to electric components (not shown). The plug-in connection elements 1 and 2 have housings 5 and 6, which are constructed complementary to one another and which can be pushed into one another or pulled out of one another.

During the joining of the plug-in connection elements 1 and 2, a variable contact force can be triggered between the pertaining contact elements 3 and 4 transversely to the movement direction of the two housing parts. This takes place by way of a ramp 7 and an elastic pressure part 8 that can be moved by way of the ramp, by which a position-dependent increase of the contact force between the contact parts 3 and 4 is caused.

The ramp function is a result of a slope 9 on an operating part 10; the part of the housing 6 is connected with the shape of the pressure part 8. The operating part 10 can be displaced within the housing 6 relative to the housing 6. In addition, a two-step locking mechanism, which is not shown in detail, is illustrated whose constructive effect for the first step is shown in FIG. 1*a*. In this case, the two contact elements 3 and 4 are already resting on one another. The contact pressure is low or does not exist. Housing 5 and housing 6 are already in their end position. The operating part 10 cannot be moved with respect to the housing as long as the first locking position has not been reached.

Figure 1B:
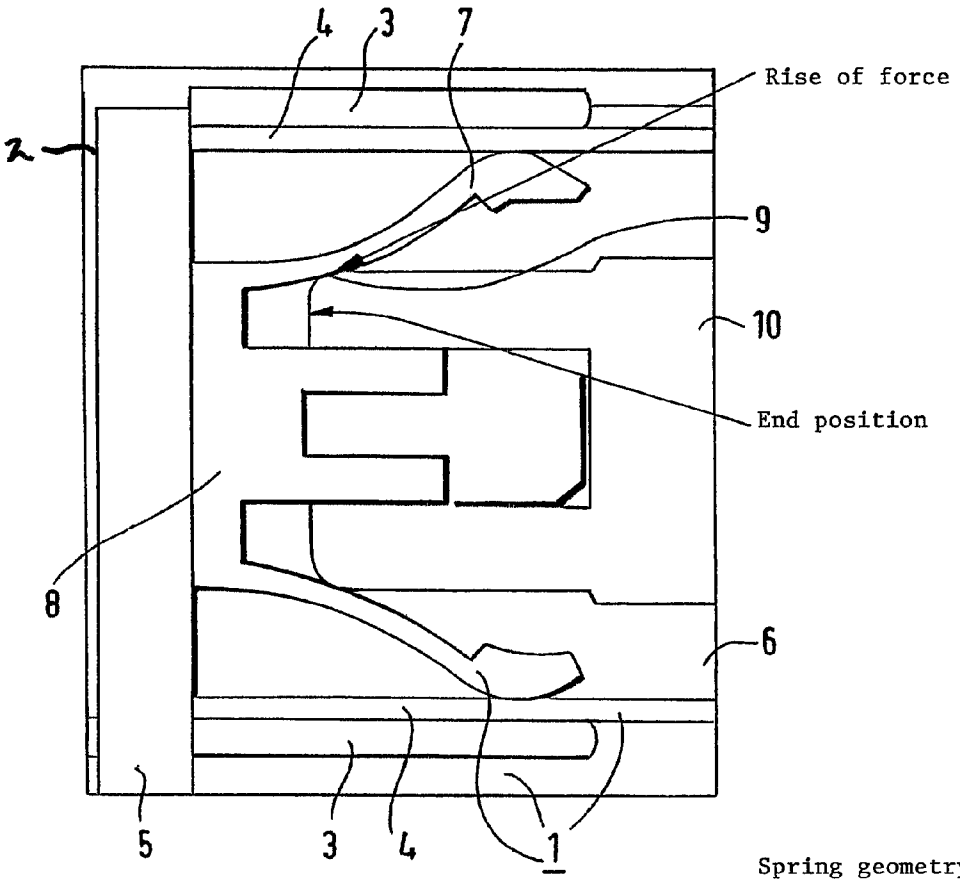

Starting from the initial position illustrated in FIG. 1*a*, the operating part 10 can now be displaced within the housing to the end position of FIG. 1*b*. In this end position, a locking between the operating part 10 and the housing 5 becomes effective, which locking is not shown.

During the movement of the operating part 10, the pressure part 8 slides over the slope 9 onto the operating element 10 and acts with increasing pressure onto the two contact parts 3 and 4. Contact part 3 is fixed in the transverse direction. It can therefore not escape with the result of an increasing contact force between the two contact parts 3 and 4.

When the locking between the operating part 10 and the housing 5 is released, the described operation can be reversed. The operating part 10 is withdrawn from the housing 6 to the first locking position of FIG. 1*a*. As a result, the contact pressure between the two contact parts 3 and 4 continues to decrease. If, subsequently, the locking between housings 5 and 6 is released, the two contact parts 3 and 4 can then be pulled apart again.

Figure 2A:
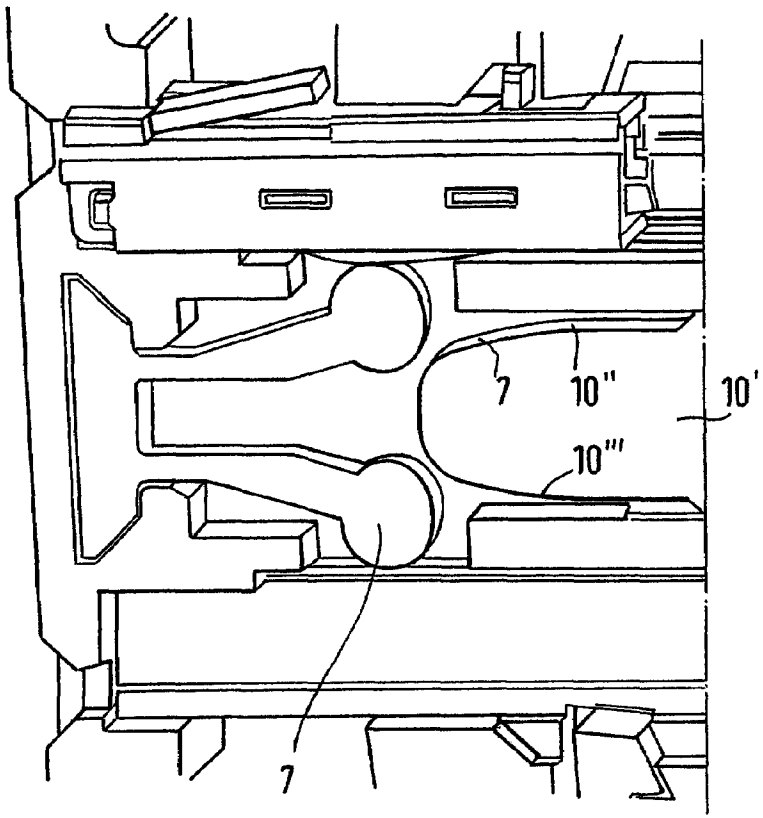
FIGS. 2*a* and 2*b* illustrate another embodiment of an electrical plug-in connection system according to the invention.
Figure 2B:
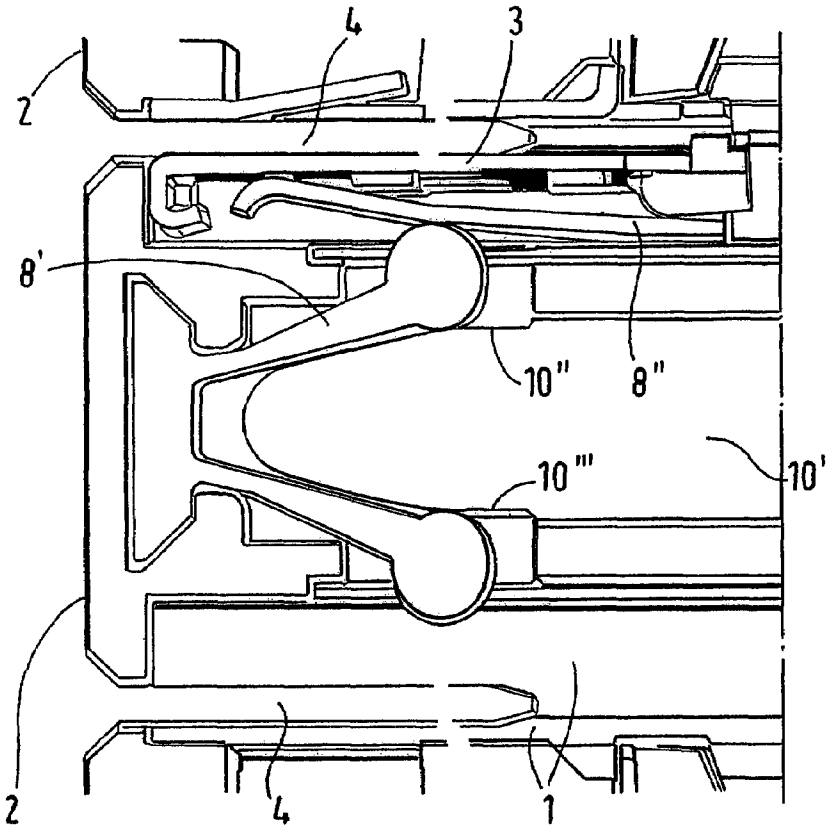

In the embodiment of FIG. 2, parts having the same function are provided with the same reference numbers as in FIG. 1. In contrast to FIG. 1, the operating part 10' is in one piece and acts with its top side 10" and its bottom side 10''' in each case upon one of the two contacts with the contact parts 3, 4. The pressure part consists of two parts 8' and 8" in order to even out the pressure distribution and the pressure rise when the operating part 10' is slid into its end position (FIG. 2*b*).

Naturally, the invention can also be applied to connection elements with a plurality of contact points. In this case, FIGS. 1 and 2 in each case show only two electrical connections for the purpose of improved clarity. In addition, the further development of the housing is within a constructor's design range and can be determined by the respective usage.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electrical plug-in connection system, comprising:

a first electrical plug-in connection element having a first housing and a number of contact elements;

a second electrical plug-in connection element having a second housing and a corresponding number of opposite contact elements;

wherein a plug-in connection between the contact elements and the respective corresponding number of opposite contact elements occurs via relative movement of the first and second housings and includes a locking connection between the first and second housings; and wherein the first and second electrical plug-in connection elements are operatively configured such that, during a relative movement of the first and second housings in a first step, a locking of the first and second housings takes place essentially without causing contact between the contact elements of the first housing and the respective corresponding number of opposite contact elements of the second housing, and, during a transition into an end position in a second step, contact between the contact elements and the respective corresponding number of opposite contact elements occurs with a position-dependent increase of contact force.

2. The electrical plug-in connection system according to claim 1, wherein one of the first and second housings comprises two partial housings, which two partial housings are moveable relative to one another; and wherein the relative movement of the two partial housings cannot occur before the transition into the end position in the second step; and wherein during the relative movement of the two partial housings, the position-dependent increase of the contact force occurs transversely to the movement direction of the first and second housings.

3. The electrical plug-in connection system according to claim 1, further comprising:

a ramp operatively configured in one of the first and second housings;

a pressure part operatively configured in the other of the first and second housings, which pressure part is moveable via the ramp to cause the position-dependent increase of the contact force between the contact elements and the respective corresponding number of opposite contact elements.

4. The electrical plug-in connection system according to claim 2, further comprising:

a ramp operatively configured in one of the first and second housings;

a pressure part operatively configured in the other of the first and second housings, which pressure part is moveable via the ramp to cause the position-dependent increase of the contact force between the contact elements and the respective corresponding number of opposite contact elements.

5. A method of establishing an electrical plug-in connection between a first electrical plug-in connection element having a first housing and a second electrical plug-in connection element having a second housing, a number of contact elements being provided in the first housing and a corresponding number of opposite contact elements being provided in the second housing, the method comprising the acts of:

during a relative movement of the first and second housings with respect to one another in a first step, locking the first and second housings together substantially without providing contact between the contact elements of the first housing and the respective corresponding number of opposite contact elements of the second housing; and during a transition into an end position of the first and second housings during a second step, providing actual contact between the contact elements of the first housing and the corresponding number of opposite contact elements of the second housing with a position-dependent increase of contact force.

* * * * *